US007614451B2

(12) United States Patent
Blaschke et al.

(10) Patent No.: US 7,614,451 B2
(45) Date of Patent: Nov. 10, 2009

(54) METHOD FOR CONSTRUCTING AND TREATING SUBTERRANEAN FORMATIONS

(75) Inventors: Keith Blaschke, Duncan, OK (US); Stanley Combs, Comanche, OK (US); John Heaton, Duncan, OK (US); Bryan Walker, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 349 days.

(21) Appl. No.: 11/675,812

(22) Filed: Feb. 16, 2007

(65) Prior Publication Data

US 2008/0197605 A1 Aug. 21, 2008

(51) Int. Cl.
*E21B 33/13* (2006.01)

(52) U.S. Cl. ..... 166/285; 414/482

(58) Field of Classification Search ..... 166/285; 280/402; 414/482, 499
See application file for complete search history.

(56) References Cited

U.S. PATENT DOCUMENTS

| | | | |
|---|---|---|---|
| 2,223,509 | A | 12/1940 | Brauer |
| 2,230,589 | A | 2/1941 | Driscoll |
| 2,407,010 | A | 9/1946 | Hudson |
| 2,472,466 | A | 6/1949 | Counts et al. |
| 2,647,727 | A | 8/1953 | Edwards |
| 2,675,082 | A | 4/1954 | Hall |
| 2,849,213 | A | 8/1958 | Failing |
| 2,919,709 | A | 1/1960 | Schwegman |
| 3,051,246 | A | 8/1962 | Clark, Jr. et al. |
| 3,193,010 | A | 7/1965 | Bielstein |
| 3,277,962 | A | 10/1966 | Flickinger et al |
| 3,570,596 | A | 3/1971 | Young |
| 3,948,322 | A | 4/1976 | Baker |
| 3,948,588 | A | 4/1976 | Curington et al. |
| 3,951,208 | A | 4/1976 | Delano |
| 4,105,069 | A | 8/1978 | Baker |
| 4,271,916 | A | 6/1981 | Williams |
| 4,300,633 | A | 11/1981 | Stewart |
| 4,304,298 | A | 12/1981 | Sutton |

(Continued)

FOREIGN PATENT DOCUMENTS

EP 0 419 281 A2 3/1991

(Continued)

OTHER PUBLICATIONS

Griffith, et al., "Reverse Circulation of Cemet on Primary Jobs Increases Cement Column Height Across Weak Formations," Society of Petroleum Engineers, SPE 25440, 315-319, Mar. 22-23, 1993.

(Continued)

*Primary Examiner*—William P Neuder
(74) *Attorney, Agent, or Firm*—John W. Wustenberg; Baker Botts, LLP

(57) ABSTRACT

A method for servicing a well comprises providing at least one trailer, providing at least one towing vehicle, providing servicing equipment, supporting the equipment with the trailer, and moving the towing vehicle, so as to move the trailer along with the equipment. The combination gross weight rating or combination gross vehicle weight of the trailer and the towing vehicle may be less than 26,001 pounds or less than less than the commercial drivers license threshold, under the Federal Motor Carrier Safety Administration's regulations.

20 Claims, 6 Drawing Sheets

U.S. PATENT DOCUMENTS 4,340,427 A 7/1982 Sutton
4,367,093 A 1/1983 Burkhalter et al.
RE31,190 E 3/1983 Detroit et al.
4,450,010 A 5/1984 Burkhalter et al.
4,457,379 A 7/1984 McStravick
4,469,174 A 9/1984 Freeman
4,519,452 A 5/1985 Tsao et al.
4,531,583 A 7/1985 Revett
4,548,271 A 10/1985 Keller
4,555,269 A 11/1985 Rao et al.
4,565,578 A 1/1986 Sutton et al.
4,671,356 A 6/1987 Barker et al.
4,676,832 A 6/1987 Childs et al.
4,729,432 A 3/1988 Helms
4,791,988 A 12/1988 Trevillion
4,961,465 A 10/1990 Brandell
5,024,273 A 6/1991 Coone et al.
5,117,910 A 6/1992 Brandell et al.
5,125,455 A 6/1992 Harris et al.
5,133,409 A 7/1992 Bour et al.
5,147,565 A 9/1992 Bour et al.
5,188,176 A 2/1993 Carpenter
5,213,161 A 5/1993 King et al.
5,273,112 A 12/1993 Schultz
5,297,634 A 3/1994 Loughlin
5,318,118 A 6/1994 Duell
5,323,858 A 6/1994 Jones et al.
5,361,842 A 11/1994 Hale et al.
5,484,019 A 1/1996 Griffith
5,494,107 A 2/1996 Bode
5,507,345 A 4/1996 Wehunt, Jr. et al.
5,559,086 A 9/1996 Dewprashad et al.
5,571,281 A 11/1996 Allen
5,577,865 A 11/1996 Manrique et al.
5,624,183 A * 4/1997 Schuff ..... 366/20
5,641,021 A 6/1997 Murray et al.
5,647,434 A 7/1997 Sullaway et al.
5,671,809 A 9/1997 McKinzie
5,718,292 A 2/1998 Heathman et al.
5,738,171 A 4/1998 Szarka
5,749,418 A 5/1998 Mehta et al.
5,762,139 A 6/1998 Sullaway et al.
5,803,168 A 9/1998 Lormand et al.
5,829,526 A 11/1998 Rogers et al.
5,875,844 A 3/1999 Chatterji et al.
5,890,538 A 4/1999 Beirute et al.
5,897,699 A 4/1999 Chatterji et al.
5,900,053 A 5/1999 Brothers et al.
5,913,364 A 6/1999 Sweatman
5,968,255 A 10/1999 Mehta et al.
5,972,103 A 10/1999 Mehta et al.
6,060,434 A 5/2000 Sweatman et al.
6,063,738 A 5/2000 Chatterji et al.
6,098,710 A 8/2000 Rhein-Knudsen et al.
6,138,759 A 10/2000 Chatterji et al.
6,143,069 A 11/2000 Brothers et al.
6,167,967 B1 1/2001 Sweatman
6,196,311 B1 3/2001 Treece et al.
6,204,214 B1 3/2001 Singh et al.
6,244,342 B1 6/2001 Sullaway et al.
6,258,757 B1 7/2001 Sweatman et al.
6,311,775 B1 11/2001 Allamon et al.
6,318,472 B1 11/2001 Rogers et al.
6,367,550 B1 4/2002 Chatterji et al.
6,431,282 B1 8/2002 Bosma et al.
6,454,001 B1 9/2002 Thompson et al.
6,457,524 B1 10/2002 Roddy
6,467,546 B2 10/2002 Allamon et al.
6,481,494 B1 11/2002 Dusterhoft et al.
6,484,804 B2 11/2002 Allamon et al.
6,488,088 B1 12/2002 Kohli et al.
6,488,089 B1 12/2002 Bour et al.
6,488,763 B2 12/2002 Brothers et al.
6,540,022 B2 4/2003 Dusterhoft et al.
6,622,798 B1 9/2003 Rogers et al.
6,666,266 B2 12/2003 Starr et al.
6,679,336 B2 1/2004 Musselwhite et al.
6,715,553 B2 4/2004 Reddy et al.
6,722,434 B2 4/2004 Reddy et al.
6,725,935 B2 4/2004 Szarka et al.
6,732,797 B1 5/2004 Watters
6,758,281 B2 7/2004 Sullaway et al.
6,802,374 B2 10/2004 Edgar et al.
6,808,024 B2 10/2004 Schwendemann et al.
6,810,958 B2 11/2004 Szarka et al.
2002/0148614 A1 10/2002 Szarka
2003/0000704 A1 1/2003 Reynolds
2003/0029611 A1 2/2003 Owens
2003/0072208 A1 4/2003 Rondeau et al.
2003/0152450 A1 * 8/2003 Henry et al. ..... 414/502
2003/0192695 A1 10/2003 Dillenbeck et al.
2004/0079553 A1 4/2004 Livingstone
2004/0084182 A1 5/2004 Edgar et al.
2004/0099413 A1 5/2004 Arceneaux
2004/0104050 A1 6/2004 Järvelä et al.
2004/0104052 A1 6/2004 Livingstone
2004/0177962 A1 9/2004 Bour
2004/0231846 A1 11/2004 Griffith et al.
2005/0061546 A1 3/2005 Hannegan
2006/0016599 A1 1/2006 Badalamenti et al.
2006/0016600 A1 1/2006 Badalamenti et al.
2006/0042798 A1 3/2006 Badalamenti et al.
2006/0086499 A1 4/2006 Badalamenti et al.
2006/0086502 A1 4/2006 Reddy et al.
2006/0086503 A1 4/2006 Reddy et al.
2006/0131018 A1 6/2006 Rogers et al.
2009/0107676 A1 4/2009 Saunders ..... 166/293

FOREIGN PATENT DOCUMENTS

GB 2193741 2/1988
GB 2 327 442 A 1/1999
GB 2348828 A 10/2000
RU 1774986 11/1992
RU 1778274 11/1992
RU 1542143 C 12/1994
RU 2067158 9/1996
RU 2086752 C1 8/1997
SU 571584 9/1977
SU 1420139 A1 8/1988
SU 1534183 1/1990
SU 1716096 A1 2/1992
SU 1723309 A1 3/1992
SU 1758211 A1 8/1992
WO WO 2004/104366 12/2004
WO WO 2005/083229 A1 9/2005
WO WO 2006/008490 A1 1/2006
WO WO 2006/064184 A1 6/2006

OTHER PUBLICATIONS

Filippov, et al., "Expandable Tubular Solutions," Society of Petroleum Engineers, SPE 56500, Oct. 3-6, 1999.

Daigle, et al., "Expandable Tubulars: Field Examples of Application in Well Construction and Remediation," Society of Petroleum Engineers, SPE 62958, Oct. 1-4, 2000.

Fryer, "Evaluation of the Effects of Multiples in Seismic Data from the Gulf Using Vertical Seismic Profiles," SPE 25540, 1993.

Carpenter, et al., "Remediating Sustained Casing Pressure by Forming a Downhole Annular Seal with Low-Melt-Point Eutectic Metal," IADC/SPE 87198, Mar. 2-4, 2004.

Halliburton Casing Sales Manual, Section 4, Cementing Plugs, p. 4-29 and 4-30, Oct. 6, 1993.

G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
Griffith, "Monitoring Circulatable Hole with Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign communication from a related counter part application, Oct. 12, 2005.
Foreign communication from a related counter part application, Sep. 30, 2005.
Foreign communication from a related counter part application, Dec. 7, 2005.
Halliburton brochure entitled "Bentonite (Halliburton Gel) Viscosifier", 1999.
Halliburton brochure entitled "Cal-Seal 60 Cement Accelerator", 1999.
Halliburton brochure entitled "Diacel D Lightweight Cement Additive", 1999.
Halliburton brochure entitled "Cementing Flex-Plug® OBM Lost-Circulation Material", 2004.
Halliburton brochure entitled "Cementing FlexPlug® W Lost-Circulation Material", 2004.
Halliburton brochure entitled "Gilsonite Lost-Circulation Additive", 1999.
Halliburton brochure entitled "Micro Fly Ash Cement Component", 1999.
Halliburton brochure entitled "Silicalite Cement Additive", 1999.
Halliburton brochure entitled "Spherelite Cement Additive", 1999.
Halliburton brochure entitled "Increased Integrity with the StrataLock Stabilization System", 1998.
R. Marquaire et al., "Primary Cementing By Reverse Circulation Solves Critical Problem in the North Hassi-Messaoud Field, Algeria", SPE 1111, Feb. 1966.
Halliburton brochure entitled "Perlite Cement Additive", 1999.
Halliburton brochure entitled "The PermSeal System Versatile, Cost-Effective Sealants for Conformance Applications", 2002.
Halliburton Brochure entitled "POZMIX® A Cement Additive", 1999.
Foreign communication from a Related counter part application, Dec. 9, 2005.
Foreign communication from a related counter part application, Feb. 24, 2005.
Foreign communication from a related counter part application, Dec. 27, 2005.
Foreign communication from a related counter part application, Feb. 23, 2006.
Foreign communication from a related counter part application, Feb. 27, 2007.
Foreign communication from a related counter part application, Jan. 8, 2007.
Foreign communication from a related counter part application, Jan. 17, 2007.

* cited by examiner

METHOD FOR CONSTRUCTING AND TREATING SUBTERRANEAN FORMATIONS

BACKGROUND

This invention relates to apparatus and methods for constructing and treating subterranean formations.

Typically, after a well for the production of oil or gas has been drilled, casing is lowered and cemented into the well bore. Normal primary cementing of the casing string in the well bore includes lowering the casing to a desired depth and displacing a desired volume of cement down the inner diameter of the casing. Cement is displaced downward into the casing until it exits the bottom of the casing into the annular space between the outer diameter of the casing and the well bore apparatus.

The casing may also be cemented into a well bore by utilizing what is known as a reverse-cementing method. The reverse-cementing method comprises displacing conventionally mixed cement into the annulus between the casing string and the annulus between an existing string, or an open hole section of the well bore. As the cement is pumped down the annular space, drilling fluids ahead of the cement are displaced around the lower ends of the casing string and up the inner diameter of the casing string and out at the surface. The fluids ahead of the cement may also be displaced upwardly through a work string that has been run into the inner diameter of the casing string and sealed off at its lower end. Because the work string has a smaller inner diameter, fluid velocities in the work string will be higher and will more efficiently transfer the cuttings washed out of the annulus during cementing operations. To ensure that a good quality cement job has been performed, a small amount of cement will be pumped into the casing and the work string. As soon as a desired amount of cement has been pumped into the annulus, the work string may be pulled out of its seal receptacle and excess cement that has entered the work string can be reverse-circulated out the lower end of the work string to the surface.

Reverse cementing, as opposed to the conventional method, provides a number of advantages. For example, cement may be pumped until a desired quality of cement is obtained at the casing shoe. Furthermore, cementing pressures are much lower than those experienced with conventional methods and cement introduced in the annulus free-falls down the annulus, producing little or no pressure on the formation. Oil or gas in the well bore ahead of the cement may be bled off through the casing at the surface. Finally, when the reverse-cementing method is used, less fluid is required to be handled at the surface and cement retarders may be utilized more efficiently.

The equipment required for reverse-cementing operations, like the equipment for the conventional method, is typically transported to the worksite via a number of tractor-trailers. Since the operation of tractor-trailers is highly regulated, the cementing operations are also controlled by Department of Transportation ("D.O.T.") regulations. These regulations cover a number of variables, including the number of hours a driver may drive. This can lead to delay in operation, and may increase costs. For example, a driver may use up all his regulated working hours to get to the worksite and set up. As a result, he cannot do any more work that day. Since time is often critical in these operations, another worker must be present to do work that the driver could otherwise do. For example, a cementer may have the ability to drive the tractor-trailer. However, rather than drive a tractor-trailer to the worksite, set up, and cement, the cementer may be required to drive a personal car to the worksite, set up, and cement. In this scenario, a separate driver drives the tractor-trailer to the worksite. Since the driver's work includes driving, he may not even be able to drive to a hotel to sleep. Instead, he often must stay at the worksite (and on the clock) without working until enough time has passed and D.O.T. regulations permit him to work again. These regulations also control the skill level of the drivers. Only drivers having a special license may operate tractor-trailers. Since obtaining this type of license requires extensive training, drivers with specialized licenses are generally more expensive than drivers without such a license. Tractor-trailers are also limited by terrain, and may not be able to get to or enter certain worksites without suitable roads first being built, which may be a costly endeavor.

While the use of tractor-trailers keeps the cost of reverse-cementing operations high, this problem is not limited to reverse-cementing operations. The costs associated with the use of tractor-trailers extend to fracturing, or acid treatments, along with a number of other production enhancement operations.

SUMMARY

This invention relates to apparatus and methods for constructing and treating subterranean formations.

In one embodiment, a method for servicing a well comprises providing at least one trailer, providing at least one towing vehicle, providing servicing equipment, supporting the equipment with the trailer, and moving the towing vehicle, so as to move the trailer along with the equipment. In this embodiment, the combination gross weight rating or combination gross vehicle weight of the trailer and the towing vehicle is less than 26,001 pounds.

In another embodiment, a method for servicing a well comprises providing at least one trailer, providing at least one towing vehicle, providing cementing equipment, supporting the equipment with the trailer, and moving the towing vehicle, so as to move the trailer along with the equipment. In this embodiment, the combination gross weight rating or combination gross vehicle weight of the trailer and the towing vehicle is less than 26,001 pounds.

In yet another embodiment, a method for servicing a well comprises providing at least one trailer, providing at least one towing vehicle, providing servicing equipment, supporting the equipment with the trailer, and moving the towing vehicle, so as to move the trailer along with the equipment. In this embodiment, the combination gross weight rating or combination gross vehicle weight of the trailer and the towing vehicle is less than the commercial drivers license threshold, under the Federal Motor Carrier Safety Administration's regulations.

DETAILED DESCRIPTION

Figure 1:
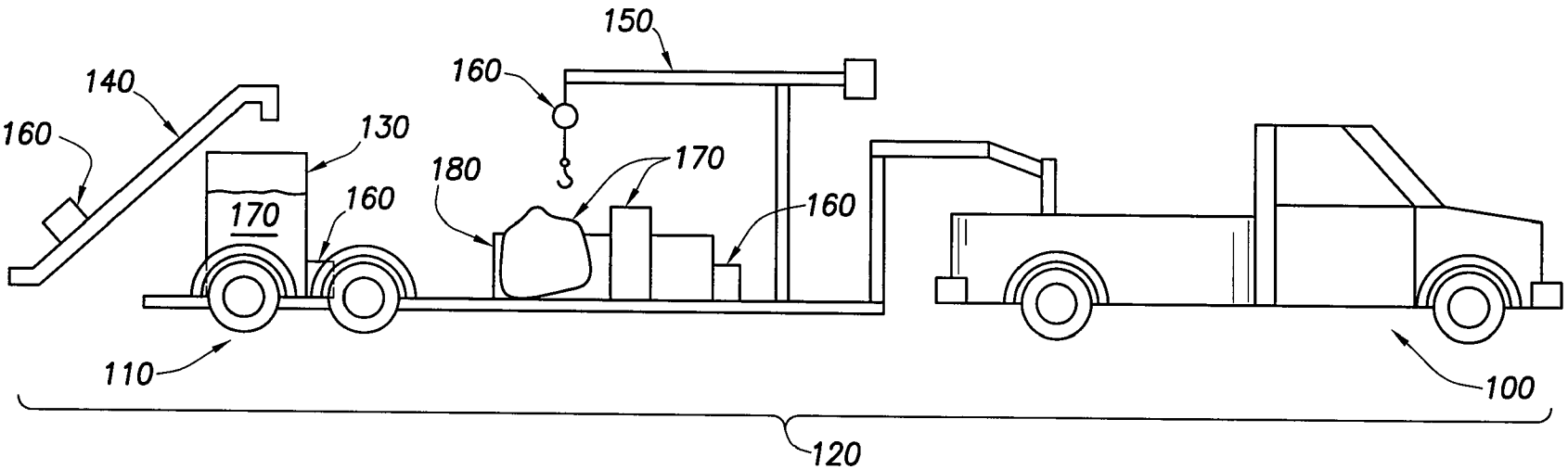
FIG. 1 is a side view of one embodiment of a method for servicing wells, showing a towing vehicle and trailer used for hauling equipment and material to and/or from worksites.

Referring now to the drawings, and more particularly to FIG. 1, shown therein is one embodiment of a method for servicing wells, such as natural gas wells or oil wells. The method may include providing at least one towing vehicle 100 and providing at least one trailer 110, which is connectable to towing vehicle 100 such that movement of towing vehicle 100 may result in movement of trailer 110. Towing vehicle 100 may be a self-propelled vehicle having a gross vehicle weight rating ("GVWR") or gross vehicle weight ("GVW") of less than 10,001 pounds (4,536 kilograms). A combined unit 120 of towing vehicle 100 and trailer 110 may have a combination GVWR or combination GVW of less than 26,001 pounds (11,794 kilograms). Alternatively, the GVWR of towing vehicle 100 and/or trailer 110 may meet "Bridge" and "Frost" laws of the United States and/or Canada. Alternatively, the axles of towing vehicle 100 and/or trailer 110 may be rated such that the GVW can traverse roads with minimal load supporting capacities.

Using trailer 110 and towing vehicle 100, this embodiment provides a financial benefit. Unlike conventional tractor-trailers, trailer 110 and towing vehicle 100 are not subject to Federal Motor Carrier Safety Administration (FMCSA) rules and regulations. In other words, the GVWR or GVW of trailer 110 and towing vehicle 100 is less than the commercial driver's license threshold, under FMCSA regulations.

When towing vehicle 100 has a GVW or GVWR less than 10,001 pounds, it is not a "commercial motor vehicle." Therefore, a person may drive it while "on duty" and below the on duty time limits, even if that person is in excess of commercial motor vehicle "driving time" limits.

According to FMCSA 395.2, "driving time" refers to all time spent at the driving controls of a commercial motor vehicle in operation. "On duty time" refers to all time from the time a driver begins to work or is required to be in readiness to work until the time the driver is relieved from work and all responsibility for performing work. Thus, a job may be completed utilizing a single, skilled crew of two persons or less.

By utilizing towing vehicle 100 and trailer 110 with a combined GVW or GVWR less than 26,001 pounds, the person driving combined unit 120 does not need to have a commercial driver's license. Further, by utilizing towing vehicle 100 with a GVW or GVWR less than 10,001 pounds, the person driving towing vehicle 100 without trailer 110 attached is not required to have a commercial driver's license. In other words, trailer 110 may be driven to the worksite by a person not skilled in cementing (i.e. a hot shot) and pre-setup for the job. Trailer 110 may be detached from towing vehicle 100, and towing vehicle 100 may be driven by non-skilled persons from the worksite, leaving trailer 110 on location pre-setup for the job. A skilled person may drive a non-equipment type vehicle, such as a regular passenger car, to location, where the equipment (i.e. trailer 110) has been previously placed. The skilled person may then perform the cementing service. Upon completion of the service, the skilled person may leave the location, driving the non-equipment type vehicle, go to another pre-setup location, and perform another service. Towing vehicles 100 may be driven to the worksite by persons not skilled in cementing (i.e. hot shot), trailers 110 previously left at the worksite may be attached to towing vehicles 100, and combined unit 120 may be driven from the worksite and transferred to the "next" location and pre-setup for another service.

Towing vehicle 100 may be self-propelled and adapted to tow trailer 110. For example, towing vehicle 100 may be a pickup truck. The pickup truck may be full-size, medium size, compact size, or utility type. The pickup truck may have a standard cab, extended cab, or crew cab, and it may have a long bed, a short bed, a very short bed, a step-side bed, or no bed. Towing vehicle 100 may alternatively be a multi-purpose vehicle, which may be full-size, mid-size, or mini-size. The multi-purpose vehicle may have passenger and/or cargo carrying capability. Another alternative for towing vehicle 100 is a sport utility vehicle, which may be large, full-size, medium size, crossover, or compact size. The sport utility vehicle may also have passenger and/or cargo carrying capability. While towing vehicle 100 is described herein as being a pickup truck, a multi-purpose vehicle, or a sport utility vehicle, one of ordinary skill in the art will appreciate that any number of vehicles are capable of towing trailer 110 and therefore, towing vehicle 100 is not limited to these specific embodiments.

Further, towing vehicles 100 and/or trailers 110 may be configured such that all towing vehicles 100 and/or trailers 110 at the worksite may be operated from any towing vehicle 100 and/or trailer 110.

While cementing applications are discussed herein, one of ordinary skill in the art will understand that this method is easily expanded to include production enhancement operations, including fracturing, and acidizing. This method of servicing a well can also include drilling, along with a number of other downhole operations.

Generally, combined unit 120 includes a power source and a control system. The power source may be an engine with associated hydraulics, pneumatics, etc. The control system may be an operator console for operations (i.e. computer, display/readout, electronics/electrical, hydraulics, pneumatics, etc.).

Combined unit 120 may be used for hauling equipment and material used in servicing wells to and/or from worksites. As shown in FIG. 1, servicing equipment onboard combined unit 120 (and supported by trailer 110) may include at least one bulk material container 130, at least one bulk material conveyor 140, at least one package holder 180, at least one package handler 150, and at least one material measuring device 160. In this embodiment, trailer 110 may be adapted to support bulk material containers 130, package holders 180, bulk material conveyors 140, package handlers 150, and/or material measuring devices 160. Trailer 110 may have one or more axle and may be a full trailer, a pole trailer, a semi-trailer (including a gooseneck), a simple trailer, or any other suitable trailer.

Material 170 may include solids, such as cements and chemical additives. Material 170 may also include liquids, such as chemical additives, pre-mixed fluids, cement slurries, drilling fluids, and water. Similarly, material 170 may include gases such as nitrogen and carbon dioxide. Material 170 may be in any form or combination of forms. Material 170 may be either bulk (loose) or prepackaged, may be in any form, and may be in any type container. Material 170 used for pumping may be solids, liquids, or gases, and may be in any form or combination of forms.

Bulk material container 130 may be any type of container, tank, or vessel used to hold or store loose or bulk material 170. It may be made of any metallic and/or non-metallic substance, such as steel, aluminum, plastic, fiberglass, or any of a number of composites. Alternatively, bulk material container 130 may be made of any substance suitable to hold material 170 in loose or bulk form. Bulk material container 130 desirably holds material 170 in variable quantities, while preventing or limiting contamination or degradation of material 170. Additionally, bulk material container 130 may prevent or limit impact to health, safety and the environment.

Bulk material conveyor 140 may be used to load and unload loose or bulk material 170 into or out of bulk material container 130. Bulk material conveyor 140 may load and/or unload loose or bulk material 170 in any form. Pneumatic, hydraulic, mechanical, electrical, and/or gravitational power may operate bulk material conveyor 140. Bulk material conveyor 140 may move loose or bulk material 170 in variable quantities and/or at a variable rate. Bulk material conveyor 140 may move loose or bulk material 170 into and/or out of bulk material container 130. Loose or bulk material 170 moved by bulk material conveyor 140 may be in solid, liquid, and/or gaseous form.

At least one package holder 180 may contain pre-packaged material 170. Package holder 180 may hold, contain, and/or secure individually pre-packaged material 170. Pre-packaged material 170 held by package holder 180 may be in solid, liquid, and/or gaseous form. Pre-packaged material 170 may be FIBC "big bags" (dry powdered cement, chemicals), or pre-packaged material 170 may be sacks, bags, boxes, etc. of dry solid material. Additionally, pre-packaged material 170 may be bottles, cans, buckets, barrels, etc. of liquid material or pre-packaged material 170 may be bottles, vessels, etc. of gaseous material.

Package handler 150 may load, position, reposition, and/or unload pre-packaged material 170 onto and/or off of package holder 180. Package handler 150 may be pneumatic, hydraulic, mechanical, electrical and/or gravitational and may load, position, reposition, and/or unload pre-packaged material 170 onto or off of package holder 180.

Material measuring device 160 may measure and control material inventory and quality. Material measuring device 160 may be mechanical, electrical, ultrasonic, acoustic, radar and/or visual and may measure properties of material 170. Measurements may be taken when material 170 is in solid, liquid, and/or gaseous form. Material measuring device 160 may take measurements at bulk material container 130, package holder 180, bulk material conveyor 140, and/or package handler 150. Material measuring device 160 may qualify material properties, such as density, stratification, consistency, particle size, moisture (water) content, viscosity, rheological, temperature, pressure, electrical stability, and/or retort (solid/liquid/gas ratio). Additionally, material measuring device 160 may quantify volume, level and/or mass (weight) of loose or bulk material 170 in bulk material container 130. Material measuring device 160 may also quantify volume, mass (weight) and/or quantity (inventory) of pre-packaged material 170 on package holder 180. Further, material measuring device 160 may quantify rate of volume and/or mass (weight) of material 170 conveyed and/or handled by the respective bulk material conveyor 140 and package handler 150.

Figure 2:
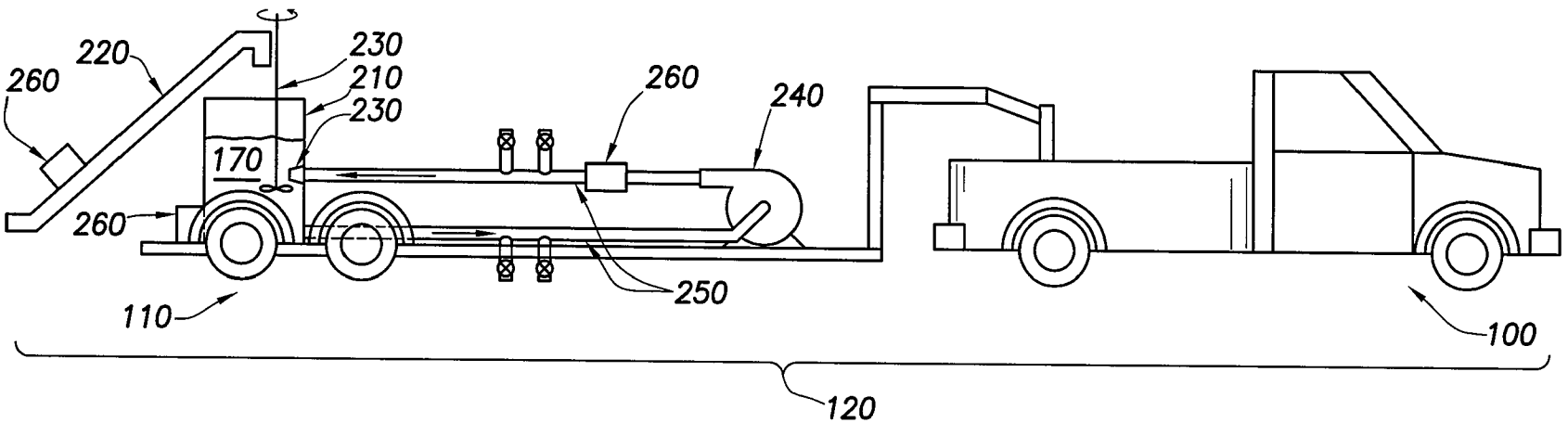
FIG. 2 is a side view of another embodiment of a method for servicing wells, showing a towing vehicle and trailer used for combining, mixing, blending, or otherwise preparing treatment material.

In an alternative embodiment, combined unit 120 may be used for combining, mixing, or blending materials, or otherwise preparing treatment materials used in servicing wells. This may be done at either the worksite or offsite. As shown in FIG. 2, servicing equipment onboard combined unit 120 (and supported by trailer 110) may include the following: at least one holding tank 210, at least one holding tank conveyor 220, at least one mixing device 230, at least one mixing pump 240, at least one mixing manifold 250 or manifold system, and at least one mixing measuring device 260. In this embodiment, trailer 110 may be adapted to support holding tanks 210, holding tank conveyors 220, mixing devices 230, mixing pumps 240, mixing manifolds 250, and/or mixing measuring devices 260.

Combined unit 120 may be useful for blending dry materials with dry materials, such as dry cements with dry chemical additives. Alternatively, it may be useful for mixing liquid materials with liquid materials, such as liquid chemical additives with water or a cement slurry. Additionally, combined unit 120 may be used for mixing dry materials with liquid materials, such as dry cements or blends with water, or dry chemical additives with liquid chemical additives, water or a cement slurry. In addition, it may be used for mixing or injecting gaseous materials with or into liquid materials, such as nitrogen with or into a cement slurry. The combining or mixing process may be continuous, batch, or a combination of continuous and batch.

Material 170 to be combined, mixed, or blended may be dry solid particles, such as dry powdered cements or chemicals, or material 170 may be liquid, such as cement slurries, chemicals, or water. Additionally, material 170 may be gaseous material, such as nitrogen.

Holding tank 210 may hold material 170 either before or after mixing or both. Additionally, mixing may take place in holding tank 210. Holding tank 210 may be any type of container, tank, or vessel. It may be made of any metallic and/or non-metallic substance, such as steel, aluminum, plastic, fiberglass, or any of a number of composites. Holding tank 210 may hold material 170 in any form, including bulk, and loose. It may hold material 170 in variable quantities, both before and after combining.

Holding tank conveyor 220 may be used to add material 170 to or from holding tank 210. Holding tank conveyor 220 may be pneumatic, hydraulic, mechanical, electrical, and/or gravitational, and it may add or load material 170 in any form, including bulk or loose. Holding tank conveyor 220 may add materials in variable quantities. Holding tank conveyor 220 may load and/or unload material 170 at variable rates into and/or out of holding tank 210. Material 170 moved by holding tank conveyor 220 may be in solid, liquid, and/or gaseous form.

Mixing device 230, or agitator, may be pneumatic, hydraulic, mechanical, and/or electrical. Some examples of suitable mixing devices 230 include paddles, pumps, propellers, jets, nozzles, ultrasonic, and acoustic devices. However, any device capable of stirring or moving material 170 within holding tank 210 is within the scope of this invention. Mixing device 230 may circulate or recirculate material 170 inside holding tank 210, outside holding tank 210, or a combination thereof. Material 170 may be added to holding tank 210 before, during, or after combining, and it may be in solid, liquid, and/or gaseous form.

Mixing pump 240 may circulate or recirculate material, for pressure treatment and/or assist in mixing. Mixing pump 240 may be pneumatic, hydraulic, mechanical, and/or electrical. Some examples of mixing pumps 240 include positive displacement devices, such as reciprocating or rotary, dynamic, and jet. Mixing pump 240 may have variable and/or various pressures, rates, and displacements, or any combination thereof. Material 170 pumped with mixing pump 240 may be in solid, liquid, and/or gaseous form. In an alternate embodiment (not shown), mixing pump 240 may be eliminated (i.e., gravity feed out).

Mixing manifold 250 may control circulation or recirculation and/or delivery of mixed material 170 to holding tank 210 and mixing pump 240. Mixing manifold 250 maybe made of any metallic and/or non-metallic substance, such as steel, aluminum, plastic, fiberglass, or any of a number of composites. Mixing manifold 250 may have pipes or tubes of variable and/or various sizes, shapes, and/or forms. Additionally, mixing manifold 250 may have valves and/or actuators of various sizes. Material 170 carried by mixing manifold 250 may be solid, liquid, and/or gaseous in form.

Mixing measuring device 260 may be used for measuring and controlling material mixing, inventory, and/or quality. Mixing measuring device 260 may be mechanical, electrical, ultrasonic, acoustic, radar, and/or visual. Mixing measuring device 260 may measure properties of material 170 in solid, liquid, and/or gaseous form. Mixing measuring device 260 may measure at holding tank 210, holding tank conveyor 220, mixing device 230, mixing pump 240, and/or mixing manifold 250. These measurements may be used to qualify properties of material 170, such as density, stratification, consistency, particle size, moisture content, viscosity, rheological, temperature, pressure, electrical stability, and/or retort (solid/liquid/gas ratio). Additionally, these measurements can be used to quantify volume, level, and/or mass of material 170 in holding tank 210. These measurements can also be used to quantify rate of volume and/or mass of material 170 conveyed and/or pumped. In an alternate embodiment (not shown), mixing measuring device 260 may be eliminated (i.e., visual check).

Figure 3:
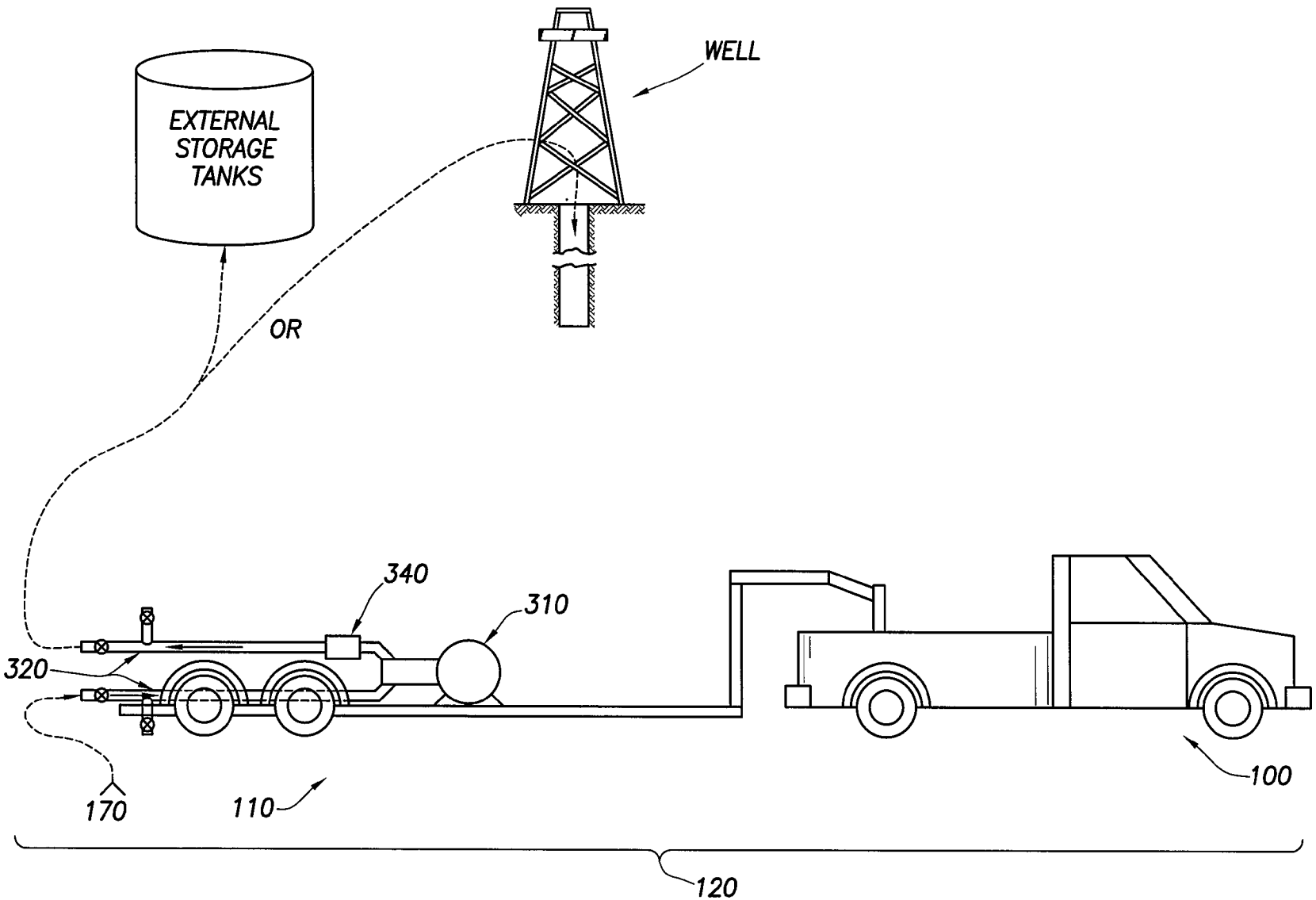
FIG. 3 is a side view of yet another embodiment of a method for servicing wells, showing a towing vehicle and trailer used for pumping material.

In an alternative embodiment, combined unit 120 may be used for pumping materials used in servicing wells. This may be done at the worksite. As shown in FIG. 3, servicing equipment onboard combined unit 120 (and supported by trailer 110) may include at least one delivery pump 310, at least one pumping manifold 320, and at least one pumping measuring device 340. In this embodiment, trailer 110 may be adapted to support delivery pumps 310, pumping manifolds 320, and/or pumping measuring devices 340.

Delivery pump 310 may provide pressure to circulate or recirculate and move materials. Delivery pump may be pneumatic, hydraulic, mechanical, and/or electrical. Some examples of delivery pumps 310 include positive displacement devices, such as reciprocating or rotary, dynamic, and jet. Delivery pump 310 may have variable and/or various pressures, rates, and displacements, or any combination thereof. Material 170 pumped with delivery pump 310 may be in solid, liquid, and/or gaseous form.

Pumping manifold 320 or manifold system may control circulation or recirculation and delivery of material 170 to delivery pump 310, external tanks, and wells. Pumping manifold 320 may be made of any metallic and/or non-metallic substance, such as steel, aluminum, plastic, fiberglass, or any of a number of composites. Pumping manifold 320 may have pipes or tubes of variable and/or various sizes, shapes, and/or forms. Additionally, pumping manifold 320 may have valves and/or actuators of various sizes. Material 170 carried by pumping manifold 320 may be solid, liquid, and/or gaseous in form.

Pumping measuring device 340 may measure and control material inventory and quality. Pumping measuring device 340 may be mechanical, electrical, ultrasonic, acoustic, radar, and/or visual. Pumping measuring device 340 may measure properties of material 170 in solid, liquid, and/or gaseous form. Pumping measuring device 340 may measure at delivery pump 310 and/or at pumping manifold 320. These measurements may be used to qualify properties of material 170, such as density, particle size, moisture content, viscosity, rheological, temperature, and/or pressure. Additionally, these measurements can be used to quantify volume, and/or mass of material 170 pumped. These measurements can also be used to quantify rate of volume and/or mass of material 170 pumped. In an alternate embodiment (not shown), pumping measuring device 340 may be eliminated (i.e., visual check or no measurement/control).

Figure 4:
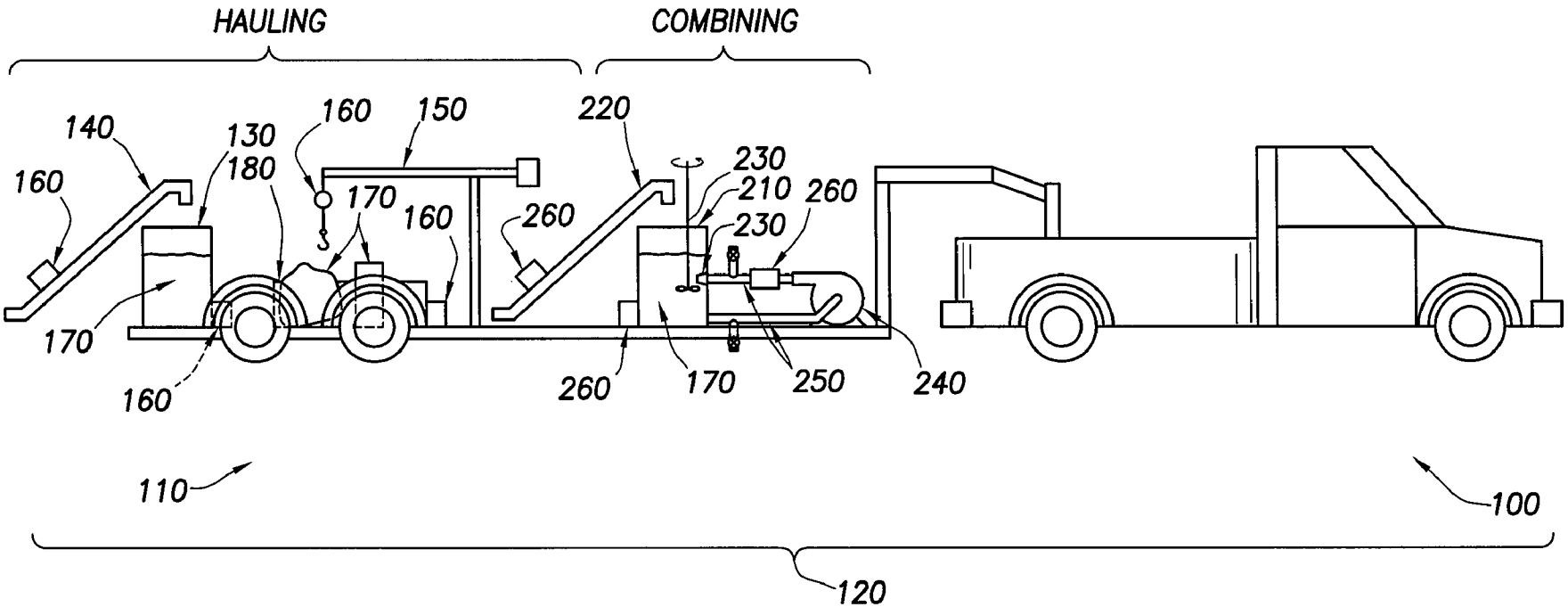
FIG. 4 is a side view of still another embodiment of a method for servicing wells, showing a towing vehicle and trailer used for both hauling equipment and material to and/or from worksites; and combining, mixing, blending, or otherwise preparing treatment material.

In an alternative embodiment, combined unit 120 may be used for the dual purposes of hauling equipment and materials used in servicing wells to and/or from worksites, along with combining, mixing, or blending materials, or otherwise preparing treatment materials used in servicing wells. This may be done at either the worksite or offsite. As shown in FIG. 4, servicing equipment onboard combined unit 120 (and supported by trailer 110) may include equipment for hauling and equipment for combining. For example, servicing equipment may include the following: at least one bulk material container 130, at least one holding tank 210, at least one bulk material conveyor 140, at least one holding tank conveyor 220, at least one package holder 180, at least one package handler 150, at least one mixing device 230, at least one mixing pump 240, at least one mixing manifold 250 or manifold system, at least one material measuring device 160, and at least one mixing measuring device 260. Bulk material container 130, bulk material conveyor 140, package holder 180, package handler 150, and material measuring device 160 are described above with respect to FIG. 1. Holding tank 210, holding tank conveyor 220, mixing device 230, mixing pump 240, mixing manifold 250, and mixing measuring device 260 are described above with respect to FIG. 2. In the embodiment shown in FIG. 4, trailer 110 may be adapted to support bulk material containers 130, bulk material conveyors 140, package holders 180, package handlers 150, and material measuring devices 160, holding tanks 210, holding tank conveyors 220, mixing devices 230, mixing pumps 240, mixing manifolds 250, and/or mixing measuring devices 260.

Figure 5:
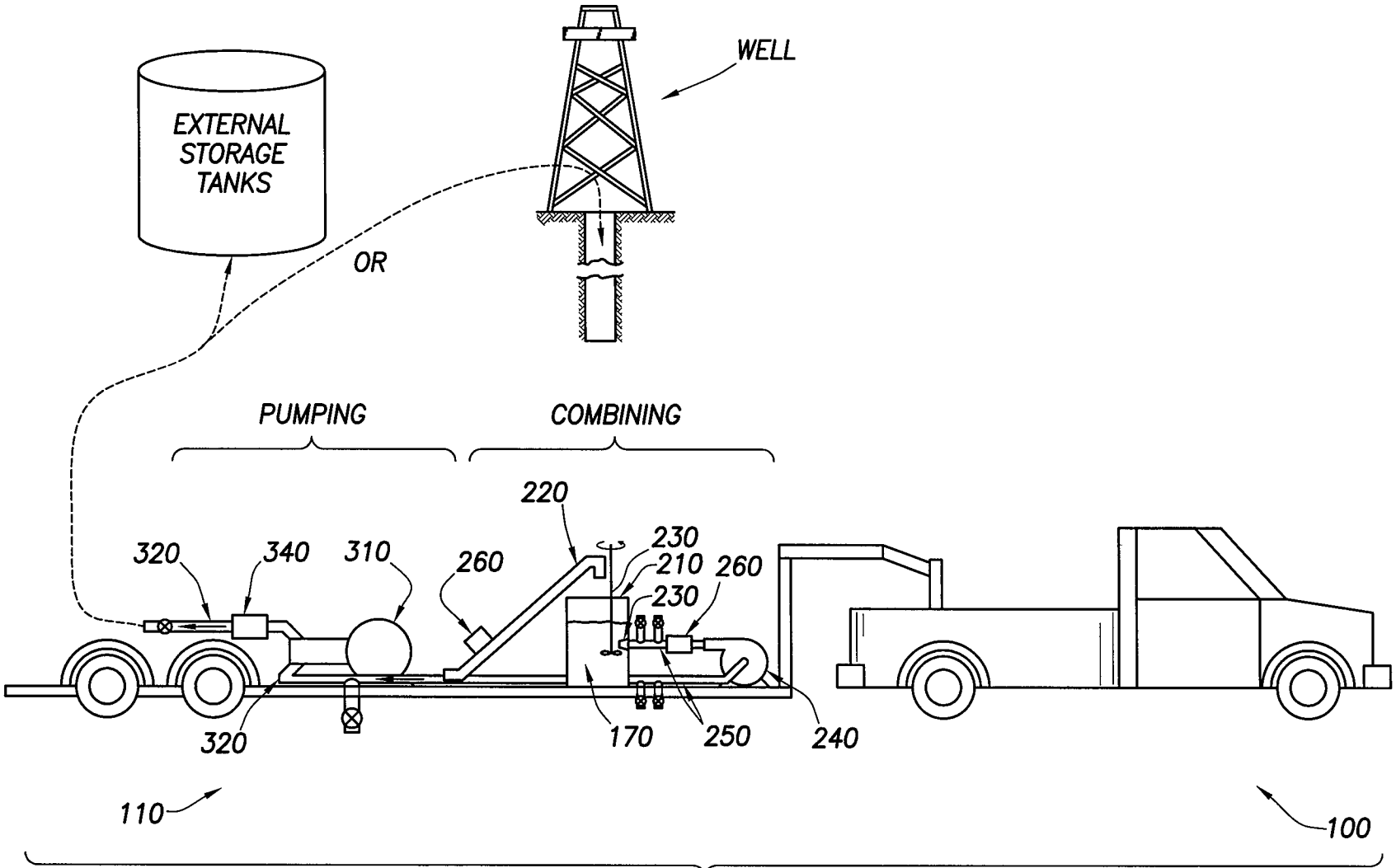
FIG. 5 is a side view of another embodiment of a method for servicing wells, showing a towing vehicle and trailer used for both combining, mixing, blending material, or otherwise preparing treatment material; and pumping material.

In an alternative embodiment, combined unit 120 may be used for the dual purposes of combining, mixing, or blending materials, or otherwise preparing treatment materials used in servicing wells, along with pumping materials used in servicing wells. This may be done at either the worksite or offsite. As shown in FIG. 5, servicing equipment onboard combined unit 120 (and supported by trailer 110) may include equipment for combining and equipment for pumping. For example, servicing equipment may include the following: at least one holding tank 210, at least one holding tank conveyor 220, at least one mixing device 230, at least one mixing pump 240, at least one mixing manifold 250 or manifold system, at least one mixing measuring device 260, at least one delivery pump 310, at least one pumping manifold 320, and at least one pumping measuring device 340. Holding tank 210, holding tank conveyor 220, mixing device 230, mixing pump 240, mixing manifold 250, and mixing measuring device 260 are described above with respect to FIG. 2. Delivery pump 310, pumping manifold 320, and pumping measuring device 340 are described above with respect to FIG. 3. In the embodiment shown in FIG. 5, trailer 110 may be adapted to support holding tanks 210, holding tank conveyors 220, mixing devices 230, mixing pumps 240, mixing manifolds 250, mixing measuring devices 260, delivery pumps 310, pumping manifolds 320, and/or pumping measuring devices 340.

Figure 6:
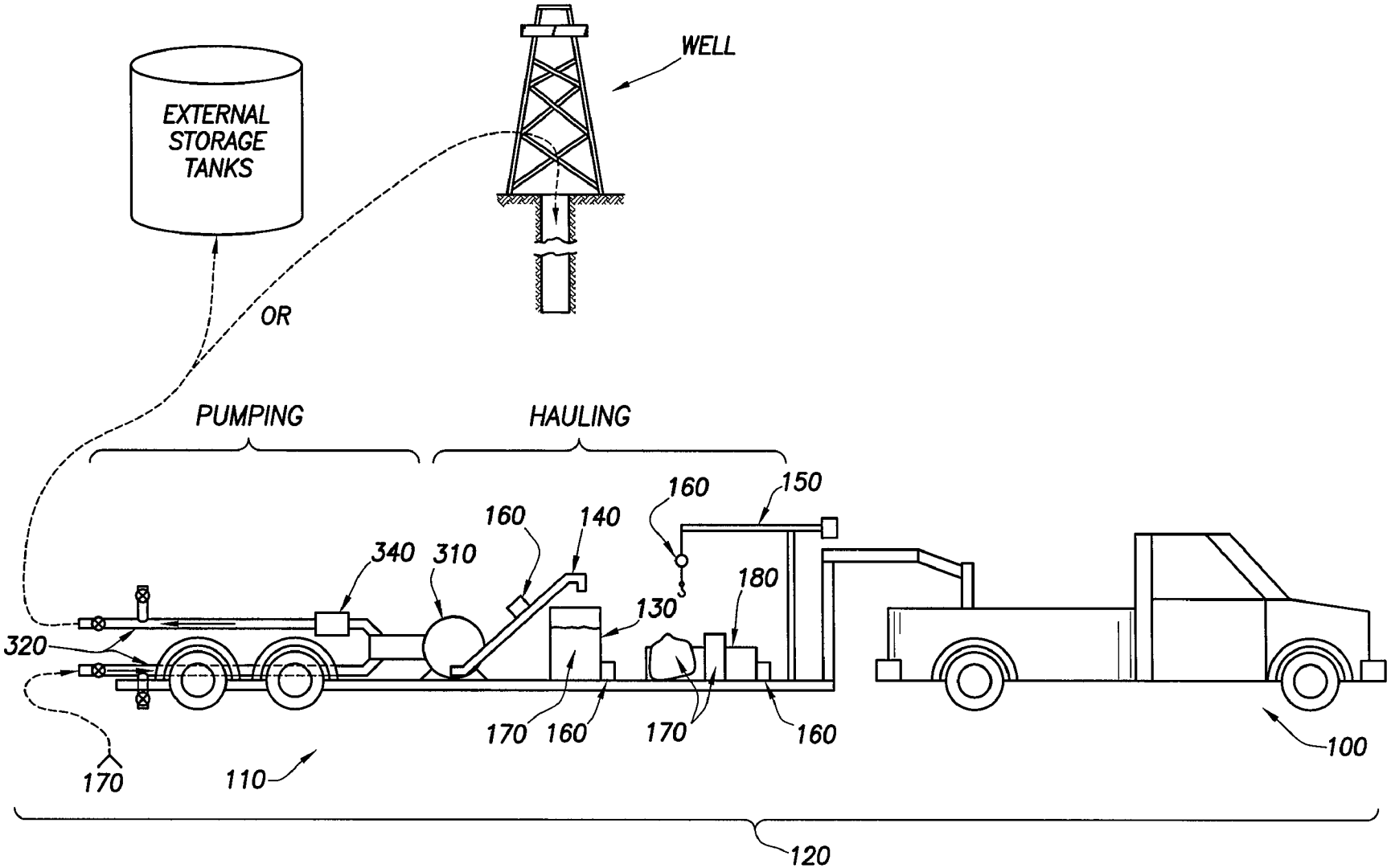
FIG. 6 is a side view of still another embodiment of a method for servicing wells, showing a towing vehicle and trailer used for both hauling equipment and material to and/or from worksites; and pumping material.

In an alternative embodiment, combined unit 120 may be used for the dual purposes of hauling equipment and materials used in servicing wells to and/or from worksites, along with pumping materials used in servicing wells. This may be done at either the worksite or offsite. As shown in FIG. 6, servicing equipment onboard combined unit 120 (and supported by trailer 110) may include equipment for hauling and equipment for pumping. For example, servicing equipment may include the following: at least one bulk material container 130, at least one bulk material conveyor 140, at least one package holder 180, at least one package handler 150, at least one material measuring device 160, at least one delivery pump 310, at least one pumping manifold 320 or manifold system, and at least one pumping measuring device 340. Bulk material container 130, bulk material conveyor 140, package holder 180, package handler 150, and material measuring device 160 are described above with respect to FIG. 1. Delivery pump 310, pumping manifold 320, and pumping measuring device 340 are described above with respect to FIG. 3. In the embodiment shown in FIG. 6, trailer 110 may be adapted to support bulk material containers 130, bulk material conveyors 140, package holders 180, package handlers 150, material measuring devices 160, delivery pumps 310, pumping manifolds 320, and/or pumping measuring devices 340.

Figure 7:
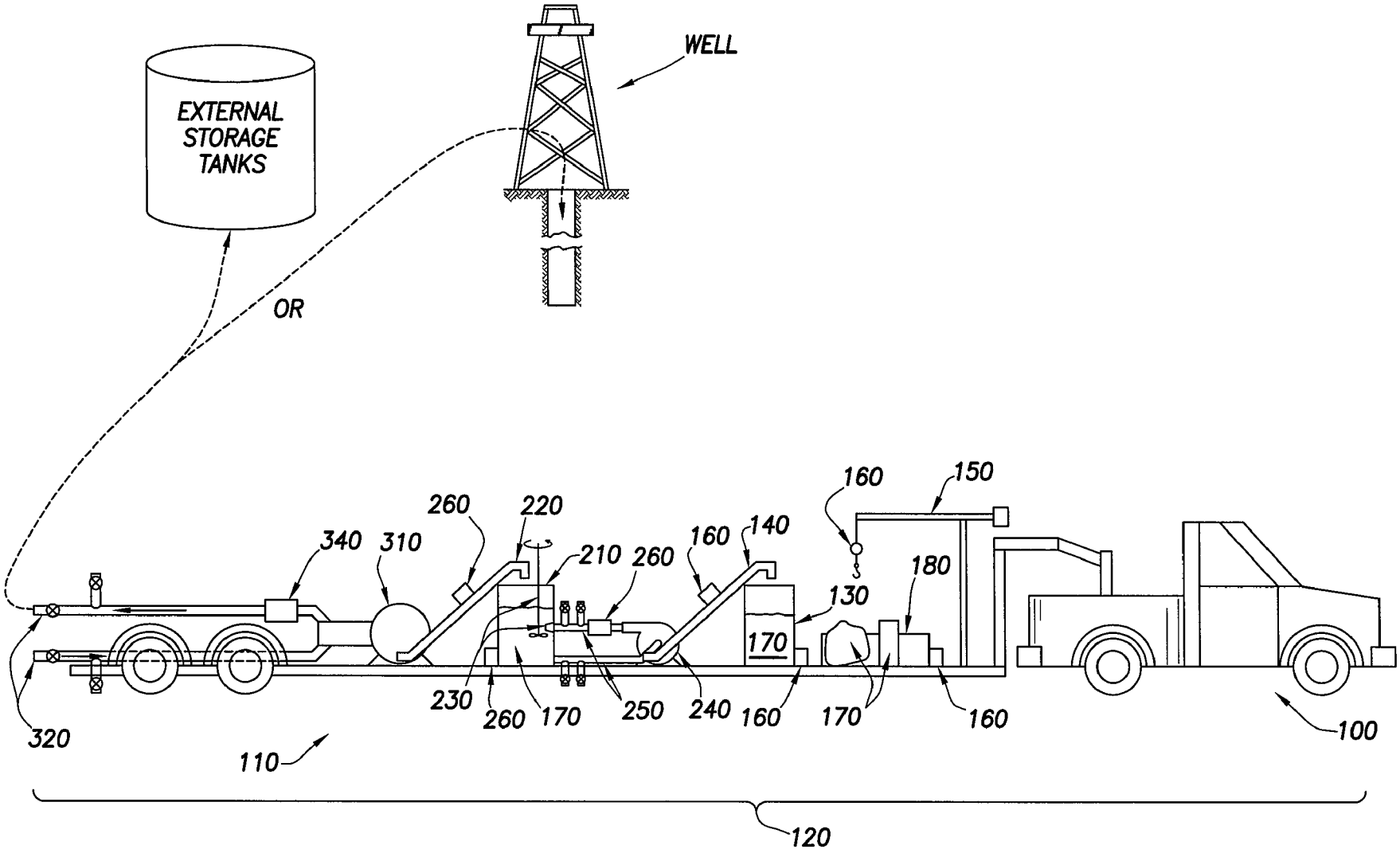
FIG. 7 is a side view of yet another embodiment of a method for servicing wells, showing a towing vehicle and trailer used for all of the following: hauling equipment and material to and/or from worksites; combining, mixing, or blending material, or otherwise preparing treatment material; and pumping material.

In an alternative embodiment, combined unit 120 may be used for the multiple purposes of hauling equipment and materials used in servicing wells to and/or from worksites, along with combining, mixing, or blending materials, or otherwise preparing treatment materials used in servicing wells, along with pumping materials used in servicing wells. This may be done at either the worksite or offsite. As shown in FIG. 7, servicing equipment onboard combined unit 120 (and supported by trailer 110) may include equipment for hauling, equipment for combining, and equipment for pumping. For example, servicing equipment may include the following: at least one bulk material container 130, at least one bulk material conveyor 140, at least one package holder 180, at least one package handler 150, at least one material measuring device 160, at least one holding tank 210, at least one holding tank conveyor 220, at least one mixing device 230, at least one mixing pump 240, at least one mixing manifold 250 or manifold system, at least one mixing measuring device 260, at least one delivery pump 310, at least one pumping manifold 320, and at least one pumping measuring device 340. Bulk material container 130, bulk material conveyor 140, package holder 180, package handler 150, and material measuring device 160 are described above with respect to FIG. 1. Holding tank 210, holding tank conveyor 220, mixing device 230, mixing pump 240, mixing manifold 250, and mixing measuring device 260 are described above with respect to FIG. 2. Delivery pump 310, pumping manifold 320, and pumping measuring device 340 are described above with respect to FIG. 3. In the embodiment shown in FIG. 7, trailer 110 may be adapted to support the following: bulk material containers 130, package holders 180, bulk material conveyors 140, package handlers 150, material measuring devices 160, holding tanks 210, holding tank conveyors 220, mixing devices 230, mixing pumps 240, mixing manifolds 250, mixing measuring devices 260, delivery pumps 310, pumping manifolds 320, and/or pumping measuring devices 340.

As discussed above, while cementing applications are discussed herein, one of ordinary skill in the art will understand that this method is easily expanded to include production enhancement operations, including fracturing, and acidizing. This method can also include drilling, along with a number of other downhole operations. In cementing applications, servicing equipment may include cementing equipment. In production enhancement operations, servicing equipment may include production enhancement equipment, such as fracturing equipment, or acidizing equipment.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A method for servicing a well, the method comprising the steps of:

providing at least one trailer;

providing at least one towing vehicle;

providing servicing equipment, wherein the servicing equipment comprises at least one delivery pump and at least one pumping manifold;

supporting the servicing equipment with the trailer;

moving the towing vehicle to a worksite for the well, so as to move the trailer along with the servicing equipment; and servicing the well at least in part with the delivery pump and one or more treatment materials;

wherein the combination gross weight rating or combination gross vehicle weight of the trailer and the towing vehicle is less than 26,001 pounds.

2. The method of servicing a well of claim 1, wherein the servicing equipment further comprises equipment used in hauling material, the equipment comprising:

at least one bulk material container;

at least one package holder;

at least one bulk material conveyor;

at least one package handler; and at least one material measuring device.

3. The method of servicing a well of claim 1, wherein the servicing equipment further comprises equipment used in hauling material, the equipment comprising:

at least one holding tank;

at least one holding tank conveyor;

at least one mixing device; and at least one mixing manifold.

4. The method of servicing a well of claim 3, further comprising:

at least one mixing pump; and at least one mixing measuring device.

5. The method of servicing a well of claim 1, further comprising:

at least one pumping measuring device.

6. The method of servicing a well of claim 1, wherein the servicing equipment further comprises equipment used in hauling material, the equipment comprising:

at least one bulk material container;

at least one package holder;

at least one bulk material conveyor;

at least one package handler;

at least one material measuring device;

at least one holding tank;

at least one holding tank conveyor;

at least one mixing device; and
at least one mixing manifold.

7. The method of servicing a well of claim 6, further comprising:
at least one mixing pump; and
at least one mixing measuring device.

8. The method of servicing a well of claim 1, wherein the servicing equipment further comprises equipment used in combining materials, the equipment comprising:
at least one holding tank;
at least one holding tank conveyor;
at least one mixing device; and
at least one mixing manifold.

9. The method of servicing a well of claim 8, further comprising:
at least one mixing pump;
at least one mixing measuring device; and
at least one pumping measuring device.

10. The method of servicing a well of claim 1, wherein the servicing equipment further comprises equipment used in hauling materials, the equipment comprising:
at least one bulk material container;
at least one package holder;
at least one bulk material conveyor;
at least one package handler;
and
at least one pumping measuring device.

11. The method of servicing a well of claim 10, further comprising:
at least one material measuring device.

12. The method of servicing a well of claim 1, wherein the servicing equipment further comprises equipment used in hauling and combining materials, the equipment comprising:
at least one bulk material container;
at least one package holder;
at least one bulk material conveyor;
at least one package handler;
at least one holding tank;
at least one holding tank conveyor;
at least one mixing device;
at least one mixing manifold;
and
at least one pumping measuring device.

13. The method of servicing a well of claim 12, further comprising:
at least one material measuring device;
at least one mixing pump; and
at least one mixing measuring device.

14. The method of servicing a well of claim 1, wherein the servicing equipment further comprises fracturing equipment.

15. The method of servicing a well of claim 1, wherein the servicing equipment further comprises acidizing equipment.

16. A method for cementing a well, the method comprising the steps of:
providing at least one trailer;
providing at least one towing vehicle;
providing cementing equipment, wherein the cementing equipment comprises at least one delivery pump and at least one pumping manifold;
supporting the cementing equipment with the trailer;
moving the towing vehicle to a worksite for the well, so as to move the trailer along with the cementing equipment; and
cementing the well at least in part with the delivery pump;
wherein the combination gross weight rating or combination gross vehicle weight of the trailer and the towing vehicle is less than 26,001 pounds.

17. The method for cementing a well of claim 16, wherein the cementing equipment further comprises:
at least one bulk material container;
at least one package holder;
at least one bulk material conveyor;
at least one package handler; and
at least one material measuring device.

18. The method for cementing a well of claim 16, wherein the cementing equipment further comprises:
at least one holding tank;
at least one holding tank conveyor;
at least one mixing device;
at least one mixing pump;
at least one mixing manifold; and
at least one measuring device.

19. The method for cementing a well of claim 16, wherein the cementing equipment further comprises:
at least one pumping measuring device.

20. A method for servicing a well, the method comprising the steps of:
providing at least one trailer;
providing at least one towing vehicle;
providing servicing equipment, wherein the servicing equipment comprises at least one delivery pump and at least one pumping manifold;
supporting the servicing equipment with the trailer;
moving the towing vehicle to a worksite for the well, so as to move the trailer along with the servicing equipment;
preparing one or more treatment materials at the worksite; and
servicing the well at least in part with the one or more treatment materials;
wherein the combination gross weight rating or combination gross vehicle weight of the trailer and the towing vehicle is less than 26,001 pounds.

* * * * *